US010730056B2

(12) United States Patent
Maunula et al.

(10) Patent No.: US 10,730,056 B2
(45) Date of Patent: Aug. 4, 2020

(54) METHOD FOR CONTROLLING A MINERAL MATERIAL PROCESSING PLANT AND A MINERAL MATERIAL PROCESSING PLANT

(71) Applicant: Metso Minerals, Inc., Helsinki (FI)

(72) Inventors: Erno Maunula, Toijala (FI); Mikko Jokiranta, Pori (FI); Jukka-Pekka Rantanen, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 803 days.

(21) Appl. No.: 14/405,952

(22) PCT Filed: May 27, 2013

(86) PCT No.: PCT/FI2013/050576
§ 371 (c)(1),
(2) Date: Dec. 5, 2014

(87) PCT Pub. No.: WO2013/182741
PCT Pub. Date: Dec. 12, 2013

(65) Prior Publication Data

US 2015/0122921 A1 May 7, 2015

(30) Foreign Application Priority Data

Jun. 8, 2012 (FI) ..... 20125628

(51) Int. Cl.
*B02C 25/00* (2006.01)
*B07B 1/42* (2006.01)
*B02C 21/02* (2006.01)

(52) U.S. Cl.
CPC ..... *B02C 25/00* (2013.01); *B02C 21/026* (2013.01); *B07B 1/42* (2013.01)

(58) Field of Classification Search
CPC ..... B02C 25/00; B02C 21/026; B01B 1/42
(Continued)

(56) References Cited

U.S. PATENT DOCUMENTS 4,248,019 A * 2/1981 Hawley ..... B24B 49/16 451/11
4,573,641 A * 3/1986 DeWoolfson ..... B02C 19/0087 194/205
(Continued)

FOREIGN PATENT DOCUMENTS

EA 200601755 A1 2/2007
EP 2 596 867 A1 5/2013
(Continued)

OTHER PUBLICATIONS

English translation of JP2004-261758.
(Continued)

*Primary Examiner* — Shelley M Self
*Assistant Examiner* — Smith Oberto Bapthelus
(74) *Attorney, Agent, or Firm* — Andrus Intellectual Property Law, LLP

(57) ABSTRACT

A mineral material processing plant and a method for controlling thereof. The processing plant includes at least one motor, at least one actuator, a control and adjusting system, a switch for switching the processing plant to a standby mode and an arrangement for keeping selected actuators in operation with a reduced standby speed. In the method, a command is given to the processing plant to switch to the standby mode and in response to the command to switch to the standby mode, feeding of mineral material to the processing plant is limited and speed of the motor or motors of the processing plant is reduced from the processing speed (Rf) to a reduced standby speed (Rsb) and it is ensured that selected actuators of the processing plant remain operating with a reduced speed.

15 Claims, 3 Drawing Sheets

(58) Field of Classification Search
USPC ..... 241/33, 35, 30, 4
See application file for complete search history.

(56) References Cited

U.S. PATENT DOCUMENTS

| | | | | |
|---|---|---|---|---|
| 4,597,487 | A * | 7/1986 | Crosby | G07F 7/0609 194/209 |
| 5,797,548 | A * | 8/1998 | Tamura | B02C 13/30 241/101.74 |
| 7,523,879 | B2 * | 4/2009 | Umeda | B02C 18/2225 241/101.761 |
| 7,658,215 | B2 * | 2/2010 | Chapman | B02C 18/2283 144/356 |
| 7,850,103 | B2 * | 12/2010 | Eriksson | B02C 2/047 241/207 |
| 8,583,322 | B2 * | 11/2013 | Yamaguchi | B02C 21/026 144/36 |
| 9,283,568 | B2 * | 3/2016 | Belotserkovskiy | B02C 2/042 |
| 2003/0141394 | A1 * | 7/2003 | Ueda | B02C 18/18 241/73 |
| 2003/0178515 | A1 * | 9/2003 | Boerhout | B02C 23/04 241/30 |
| 2004/0148513 | A1 * | 7/2004 | Scott | G05B 19/042 726/26 |
| 2007/0034295 | A1 | 2/2007 | Chapman | |
| 2007/0131807 | A1 * | 6/2007 | Umeda | B02C 18/2225 241/34 |
| 2007/0158479 | A1 * | 7/2007 | Westerman | B02C 21/02 241/101.74 |
| 2009/0294559 | A1 * | 12/2009 | Eriksson | B02C 2/047 241/30 |
| 2009/0294560 | A1 | 12/2009 | Yamaguchi et al. | |
| 2015/0122921 | A1 * | 5/2015 | Maunula | B07B 1/42 241/30 |
| 2015/0273480 | A1 * | 10/2015 | Permi | B02C 25/00 241/30 |

FOREIGN PATENT DOCUMENTS

| | | | |
|---|---|---|---|
| JP | 2004-261758 | A | 9/2004 |
| JP | 2005-205365 | A | 8/2005 |
| JP | 2007-144275 | A | 6/2007 |
| JP | 3967497 | B2 | 8/2007 |
| RU | 46443 | U1 | 7/2005 |
| SU | 737010 | A | 5/1980 |

OTHER PUBLICATIONS

English translation of JP2005-205365.
English translaton of JP3967497.
Russian Office Action for Russian Patent Application No. 2014151206 dated Jul. 3, 2017.
PCT International Search Report dated Jan. 9, 2015.
Office Action for Japanese Patent Application No. 2015-515558 dated Feb. 9, 2018.
Office Action for European Patent Application No. 13733025.4 dated Jun. 3, 2019.

* cited by examiner

METHOD FOR CONTROLLING A MINERAL MATERIAL PROCESSING PLANT AND A MINERAL MATERIAL PROCESSING PLANT

CROSS-REFERENCE TO RELATED APPLICATIONS

This application claims priority to PCT/FI2013/050576, filed May 27, 2013, and published in English on Dec. 12, 2013 as publication number WO 2013/182741, which claims priority to FI Application No. 20125628, filed Jun. 8, 2012, incorporated herein by reference.

TECHNICAL FIELD

The invention relates to a method for controlling a mineral material processing plant and to a mineral material processing plant. The invention relates particularly, though not exclusively, to a mobile mineral material processing plant and to controlling thereof.

BACKGROUND ART

Mineral material, for example rock is gained from the earth for crushing by exploding or excavating. Mineral material can also be natural and gravel or construction waste. Mobile crushers and stationary crushing applications are used in crushing. An excavator or wheeled loader loads the material to be crushed into the crushers feed hopper from where the material to be crushed may fall into the crusher or a feeder moves the rock material towards the crusher.

A mineral material processing plant comprises one or more crushers and/or screens and possibly other apparatuses such as conveyors. A processing plant may be stationary or mobile. Particularly mobile processing plants are used in urban environment in handling of recyclable material such as construction waste.

Capacity of a processing plant is aimed to be used economically fully so that the crusher is loaded continuously with a high crushing power and simultaneously the used crushing power is directed for producing the planned product distribution. Interruptions in the crushing event reduce efficiency. Also the starting of a processing plant is a time consuming task that further impedes the efficient exploitation of the plant's capacity.

Mineral material processing plants are used also in extreme, for instance in very cold, circumstances wherein the processing plant may be required to be kept in operation also when the material to be handled is not fed into the plant. Different laws and administrative orders also regulate the use, starting and running of the processing plants.

It is an object of the invention to provide a mineral material processing plant the bringing of which into process operation is quick and safe. It is an object of the invention to provide a processing plant that can be kept in operation energy-efficiently. It is an object of the invention to enable an effective crushing or other processing time as long as possible.

SUMMARY

According to a first aspect of the invention there is provided a method for controlling a mineral material processing plant, comprising:

giving a command to the processing plant to switch to a standby mode;

limiting mineral material feeding to the processing plant in response to said command to switch to the standby mode;

reducing speed of a motor or motors of the processing plant from a processing speed to a reduced standby speed in response to said command to switch to the standby mode; and ensuring that substantially all selected actuators of the processing plant remain operating with the reduced speed.

Preferably the command to switch to the standby mode is given by operating a switch.

Preferably the command to switch to the standby mode is given automatically after a predetermined time has elapsed from fulfillment of a standby mode triggering condition.

Preferably the standby mode triggering condition is a detection or a measuring information of the amount of mineral material to be processed in the processing plant.

Preferably the standby speed is selected in accordance with the prevailing circumstances.

Preferably the prevailing circumstances comprise weather conditions and/or an operating location.

Preferably the feeding of mineral material into the processing plant is limited by stopping the actuators participating in the feeding or by reducing the speed thereof sufficiently.

In the method, preferably a command to switch back to a process mode is given to the processing plant;

speed of the motor or motors of the processing plant is raised from the standby speed to the processing speed in response to said command to switch back to the process mode; and the feeding of mineral material into the processing plant is enabled.

Preferably the command to switch to the process mode is given by operating a switch.

Preferably the command to switch to the process mode is given automatically after a predetermined time has elapsed from fulfillment of a process mode triggering condition.

Preferably the said process mode triggering condition is a detection or a measuring information of the amount of mineral material to be processed in the processing plant.

According to a second aspect of the invention there is provided a mineral material processing plant comprising at least one motor;

at least one actuator;

a control system, a switch for switching the processing plant to a standby mode; and an arrangement for keeping selected actuators of the processing plant in operation with a reduced standby speed; in which processing plant the control system is configured to control the processing plant according to a method according to the first aspect of this invention.

Preferably the mineral material processing plant comprises a crusher and/or a screen.

Preferably the mineral material processing plant is a stationary plant, a track-based plant or a wheel-based plant.

According to a third aspect of the invention there is provided a control system for controlling a mineral material processing plant which control system is configured to control the processing plant according to a method according to the first aspect of this invention.

According to a fourth aspect of the invention there is provided a computer program comprising a program code executable on a computer which program code when executed controls the computer to execute the method according to the first aspect of this invention.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will now be described, by way of example, with reference to the accompanying drawings, in which.

DETAILED DESCRIPTION

In the following description, like numbers denote like elements. It should be appreciated that the illustrated drawings are not entirely in scale, and that the drawings mainly serve the purpose of illustrating embodiments of the invention.

Figure 1A:
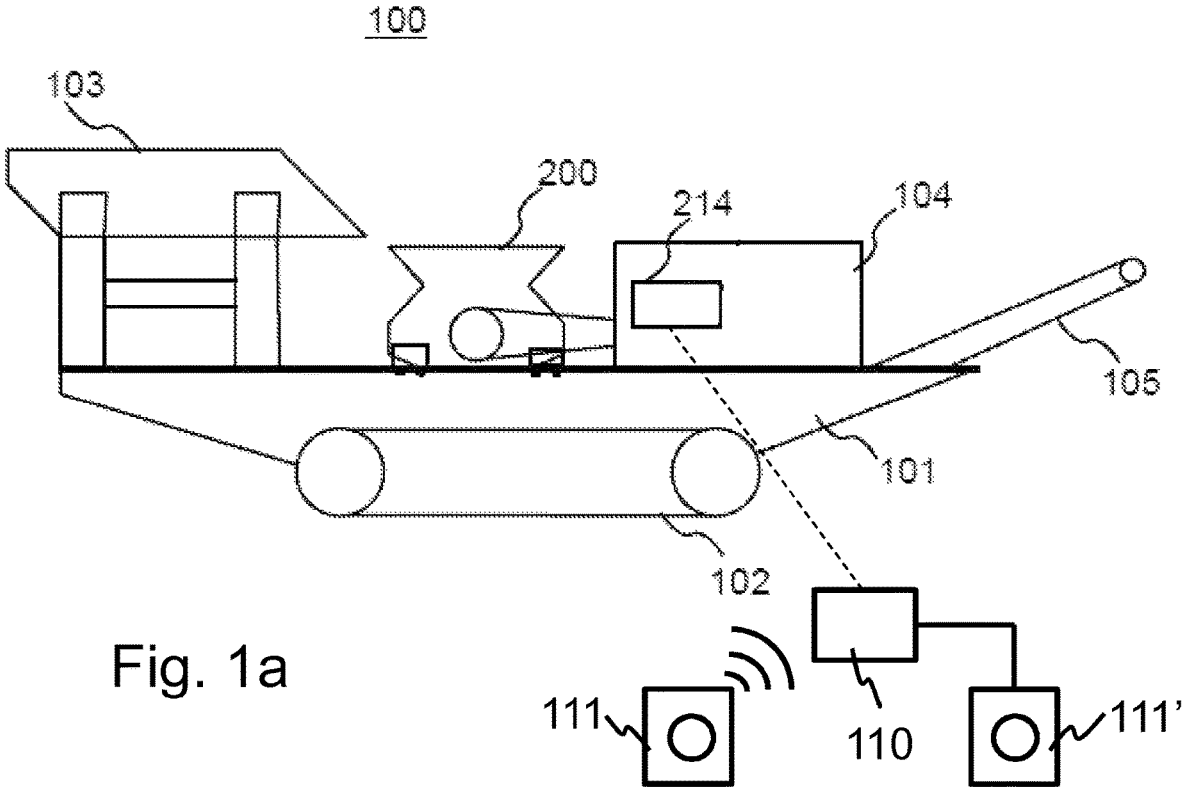
FIG. 1*a* shows a side view of a mineral material processing plant according to a preferred embodiment of the invention.

FIG. 1 shows a mobile track-mounted mineral material processing plant 100 according to an example embodiment of the invention, of which mineral material processing plant also terms processing plant and crushing plant are used in the following. The processing plant 100 comprises a body 101, a track base 102, a feeder 103 and a crusher 200 such as a cone, jaw or gyratory crusher. The crushing plant 100 further comprises a motor unit 104 for driving the crusher 200 and a conveyor 105 for conveying crushed material for example to a pile. The crusher 200 can be used for example as an intermediate or after crusher. Particularly, the crusher 200 can be used in fine crushing. The mobile crushing plant 100 may be movable also by other means such as by wheels, skids or legs. The crushing plant 100 may also be stationary. The type of the feeder 103 may be a vibratory feeder, or a belt or slat conveyor.

The crushing plant 100 further comprises a control system 214 and a control unit 110 by which the crushing plant 100 can be run to a standby mode. The control unit 110 is for the sake of clarity shown separately from the control system 214 in FIG. 1 but the control unit 110 may be integrated to the control system 214. The crushing plant 100 comprises also standby operating switches 111 and 111' that are connected to the control unit 110 either wirelessly or with a fixed connection. Alternatively, there is only one operating switch. According to a preferred embodiment the operating switch 111 and 111' may be arranged so that it can be operated with either a wireless or fixed connection. The crushing plant 100 can automatically be run in the standby mode and from the standby mode back to a process mode by the operating switches 111 and 111' with one push or like switching of the switch. According to a preferred embodiment the control unit 110 or the control system includes an arrangement with which the crushing plant 100 can be run in the standby mode or the process mode also automatically. The automatic running of the processing plant 100 to the standby mode or the process mode starts according to a preferred embodiment after a predetermined time has elapsed from fulfillment of a standby mode or process mode triggering condition.

The standby mode or the process mode triggering condition is according to a preferred embodiment a detection or a measuring information of the amount of mineral material in the processing plant 100, for example a detection that the feeding of the mineral material into the processing plant 100 is interrupted or measuring information based on which the crushing chamber of the crusher 200 is empty. The predetermined time may be selected by the operator or be automatically selected by the control unit. It should be appreciated that it is clear to a person skilled in the art that the automatic switching to the standby or process modes may be implemented also by a further known way or by selecting a further conventional triggering condition.

Figure 1B:
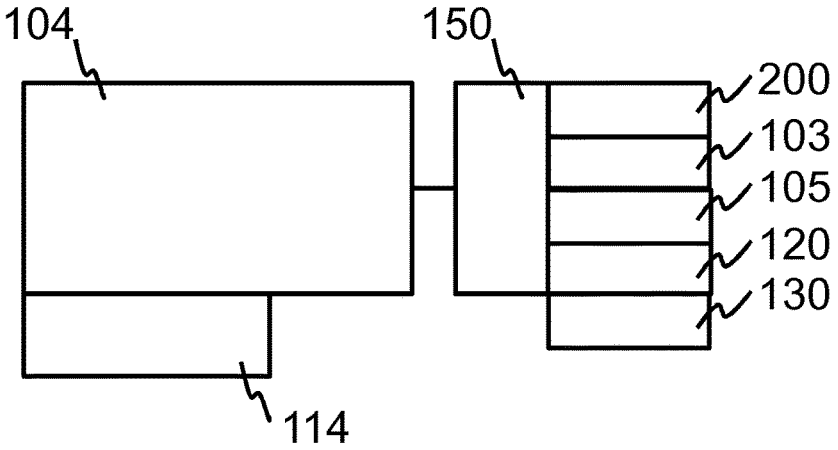
FIG. 1*b* shows schematically a power distribution arrangement of a mineral material processing plant according to a preferred embodiment of the invention.

FIG. 1*b* shows schematically a power distribution arrangement of a mineral material processing plant 100 according to a preferred embodiment. The motor 104 which may be for example a diesel or an electric motor produces operating power for the actuators, e.g. for the crusher 200, the feeder 103, the conveyor 105, the screen 120 and the vibrating chute 130. Auxiliary devices such as a cooler 114 may be positioned in connection with the motor 104. The power distribution arrangement comprises also an arrangement 150 ensuring that substantially all selected actuators remain operating in the standby mode. According to an exemplary embodiment the actuators are driven by a hydraulic system which gets its driving power from a diesel motor, and the crushing plant 100 comprises an arrangement 150 that also in the standby mode ensures distribution of hydraulic fluid flow to all selected actuators in such a proportion that the actuators remain operating with a reduced speed. According to a preferred embodiment as such an arrangement can be used for example a post compensated flow distribution valve arrangement. According to an example embodiment the actuators are operated by an electric motor or electric motors, and the crushing plant 100 includes an arrangement 150 that controls by the electric motor or electric motors the speeds of the selected actuators so that the actuators remain operating with the reduced speed. Alternatively, the actuators can be operated by a hydraulic system getting its driving power from an electric motor, or by another known power transmission arrangement. It should be appreciated that it is clear to a person skilled in the art that the power distribution arrangement of the processing plant 100 may also include other elements that are not shown in FIG. 1*b* or that in some embodiments the power distribution arrangement includes only part of the elements shown in the Figure. It is also clear that the amount of actuators shown in FIG. 1*b* is only an example and the amount and type of the actuators varies according to the configuration of the processing plant 100 depending on the situation.

Figure 2:
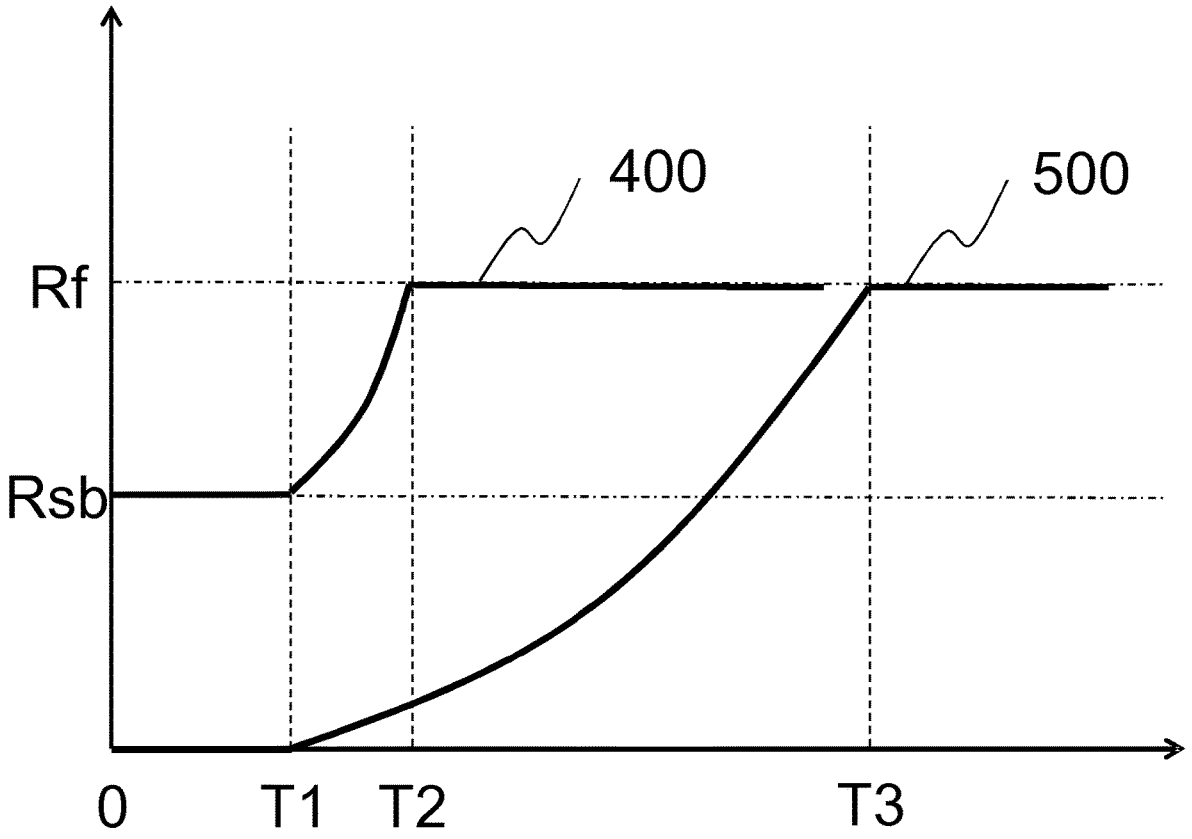
FIG. 2 shows, with reference to rotational speed, the operation of actuators of a mineral material processing plant according to a preferred embodiment of the invention which processing plant is controlled by a method according to a preferred embodiment of the invention.

FIG. 2 shows, with reference to the rotational speed of the motor(s) 104, the operation of the actuators of a mineral material processing plant 100 according to a preferred embodiment of the invention which processing plant is controlled by a method according to a preferred embodiment of the invention. FIG. 2 shows using a diagram the controlling of the crushing plant 100 to the process speed after an interruption 500 in operation and the controlling of the crushing plant 100 to the process speed from a standby mode 400 according to a preferred embodiment of the invention.

The rotational speed of the actuator or actuators is shown on the vertical axis and the time is shown on the horizontal axis of the diagram shown in FIG. 1.

The actuators of the crushing plant 100 are stopped and the motor 104 used for driving the plant is also stopped during the interruption in the operation at the time interval—0 to T1. Alternatively, the motor 104 used for driving the plant may idle whilst, however, the actuators are stopped. According to an example embodiment the motor 104 is a diesel motor or an electric motor.

The actuators must be started gradually according to a certain sequence when the crushing plant is started. Additionally, each actuator has its own rise time that is required before the actuator reaches its process speed. By the process speed is meant the speed or function mode which the actuator has during the crushing operation of the crushing plant 100, i.e. when the crushing plant 100 handles material and in which mode the motor 104 of the crushing plant 100 is running with the process speed Rf.

Also administrative orders regulate the starting of the crushing plant 100. Prior to starting, for example an acoustic signal must be given and a certain waiting time must be reserved before the starting of the actuators for ensuring safety.

The crushing plant 100 typically includes more than one actuator and there may be 12 or more actuators depending on the configuration and the intended use of the crushing plant 100. Actuators belonging to the configuration of the crushing plant 100 are for example different conveyors such as a main conveyor and a side conveyor, a conveyor equipped with a magnet for separating metal, the screen, a water pump and the crusher. Subject to the amount of the actuators and the starting sequence as described hereinbefore and the matters connected therewith, the running of the crushing plant 100 to the process speed takes a certain time depending on the configuration of the plant as can be seen on the trace 500 of the graph shown in FIG. 2. The time T1 to T3 required by the starting may be several minutes.

The time T1 to T3 required by the starting results in the crushing plant 100 typically being run with the process speed also when the material to be handled is not fed into the crushing plant 100, especially if the time during which no material is fed is short. The continuous running with the process speed increases energy consumption, noise production and exposes components of the crushing plant 100 to wear.

According to an embodiment of the invention the crushing plant 100 can be driven to standby mode instead of an interruption in operation. By the standby mode is meant a mode in which substantially all selected actuators of the crushing plant 100 remain operating with a reduced standby speed, or standby mode speed, or reduced power. In the following this reduced speed is referred to as the standby speed. The standby speed may be different for each actuator and such a speed that each actuator remains operating. By the expression that substantially all selected actuators remain operating with the reduced standby speed is meant here that apparatuses substantially connected with the crushing process, i.e. directly in contact with the processing of the mineral material remain mainly operating so that accelerating thereof to the process speed is speeded up. In some example embodiments, a part of the actuators of the crushing plant 100 are, however stopped in the standby mode, for example the feeder or the feeder conveyor may be stopped entirely in order to prevent the feeding as described hereinafter. Furthermore, in some example embodiments also some actuators, for example cooling devices or pumps, must be operated with the process speed also in the standby mode. In the standby mode the motor 104 of the crushing plant 100 runs with the standby speed Rsb that can be for instance the idle speed of the motor 104 or other speed deviating therefrom and smaller than the process speed Rf. According to a preferred embodiment the crushing plant 100 may have several standby speeds deviating from each other, of which the most appropriate can be selected for example according to prevailing circumstances such as the weather condition, comprising for instance temperature, humidity and wind speed, or according to the operating location of the crushing plant. The desired actuators that keep operating with the standby speed may be selected by the operator or automatically in advance. In an example embodiment, the selection may also be dependent on the prevailing circumstances and the configuration of the processing plant 100.

The feeding of the mineral material into the processing plant 100 is limited in the standby mode for example by stopping a feeder or a feeder conveyor or by selecting the standby speed so that the feeder or the feeder conveyor is not able to feed material into the crushing plant. Damaging or blocking of the actuators of the crushing plant 100, that could result from material ending up in the crushing plant operating with the standby speed, is prevented by limiting, or by completely eliminating, the feeding.

When the crushing plant 100 is driven from the standby speed Rsb to the process speed Rf substantially all actuators can be accelerated simultaneously, wherethrough the process speed is reached in a significantly shorter time T1 to T2 compared to the starting from an interruption in operation. The switching over from the standby speed Rsb to the process speed Rf may take for example some seconds. It is appreciated that correspondingly also switching from the process speed Rf to the standby speed Rsb requires a significantly shorter time than the switching from the process speed Rf to an interruption in operation.

The energy consumption of the crushing plant 100 is significantly smaller in the standby mode than in the process mode. The energy consumption may be for example 50% lower in the standby mode than in the process mode. Also the noise level of the crushing plant 100 decreases in the standby mode. The standby mode enables energy saving compared to continuous running with the process speed for example in very cold circumstances in which the crushing plant 100 must be kept continuously running for preventing damaging or function disruptions of the crushing plant 100. The standby mode ensures that the processing plant 100 remains warm in cold circumstances even with the reduced standby speed. For instance the used hydraulic oil and different lubricants can be kept in suitable operating temperature also with the standby speed. In said cold circumstances the standby mode can be utilized also in defrosting of the conveyors of the crushing plant 100.

The lower noise level of the standby mode also enables increasing the effective operating time of the crushing plant 100 for example in circumstances in which the cumulative noise amount generated by the crushing plant 100 is limited for example according to administrative orders. Such operating situations arise increasingly for example in urban environment in crushing of recyclable material such as material of demolished buildings.

Surprisingly the standby mode is also found to improve safety of the crushing plant 100. Moving and rotating actuators are easier to observe and thus avoid getting in contact with. Particularly, in connection with the starting from an interruption in operation some of the actuators of the crushing plant 100 may start suddenly if for example the acoustic signal indicating the starting was ignored, or an actuator in question starts at a late stage of a starting sequence, for example even after several minutes from the acoustic signal or giving of a starting command.

The standby mode can also be utilized to implement certain adjustment actions of the actuators of the crushing plant 100. For instance the jaws of a jaw crusher may be adjusted during the standby mode or regenerating of a possible diesel motor may be implemented during the standby mode instead of an interruption in operation. In some embodiments, also the position of the crushing plant 100 may be fine-tuned in the standby mode.

Figure 3:
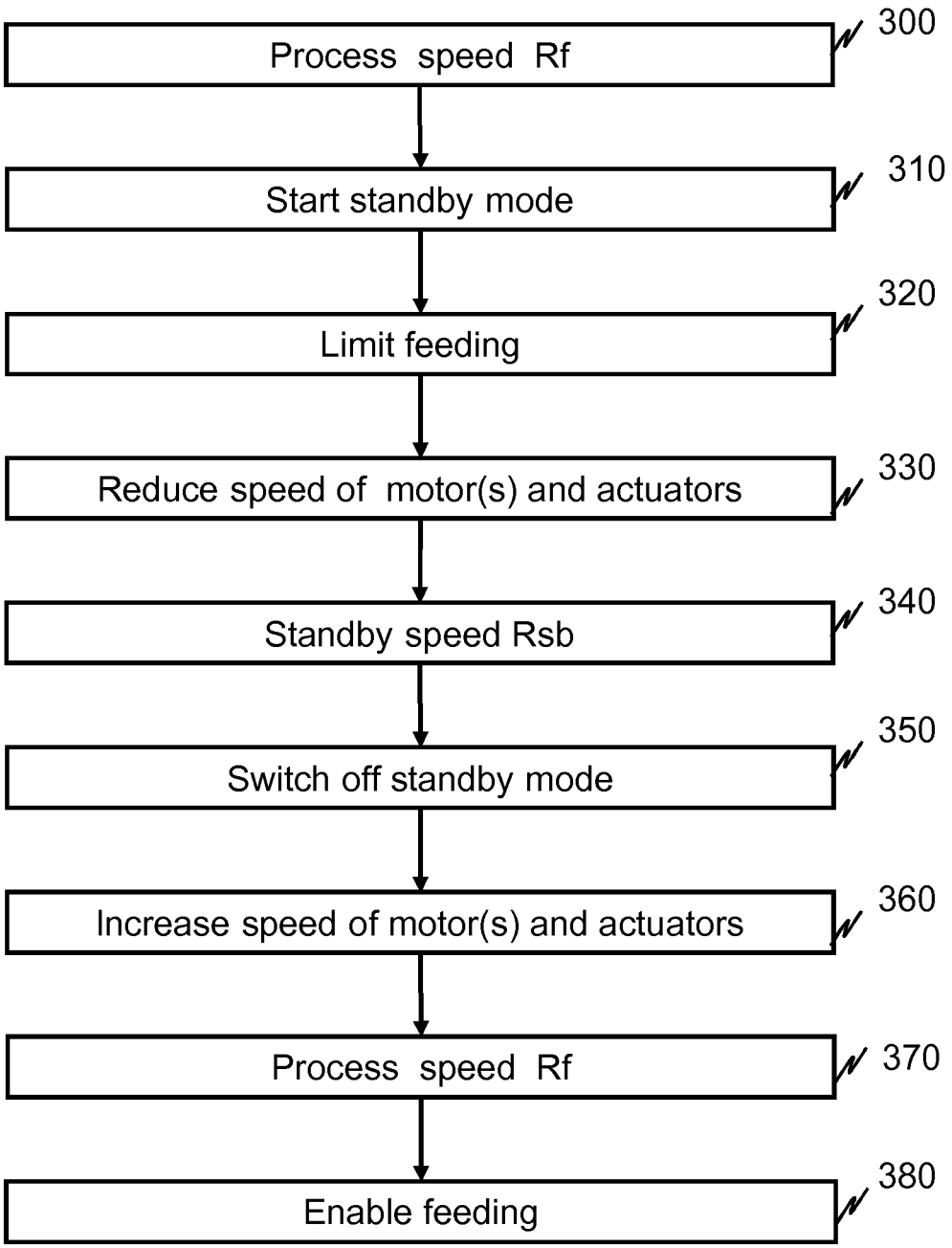
FIG. 3 shows a flow chart of a method according to a preferred embodiment of the invention.

FIG. 3 shows a flow chart of a method according to a preferred embodiment of the invention. Initially 300 the crushing plant 100 is run with the process speed Rf.

The crushing plant 100 is desired to be switched to the standby mode because of insufficiency of the material to be fed or for a further reason. The standby mode is started in step 310 for example by operating the switch 111,111'. For example the operator monitoring the crushing plant 100 starts the standby mode. Alternatively, the standby mode may be started automatically when certain conditions are met as described hereinbefore.

The feeding of mineral material into the crushing plant 100 is limited in step 320 in the way described hereinbefore by stopping the actuators taking care of the feeding or by reducing the speed thereof so that the material does not end up in the actuators.

The speed of the motor 104 or motors of the processing plant 100 and following therefrom the speed of the actuators is reduced in step 330 until the desired standby mode speed Rsb is achieved 340. After that the crushing plant 100 remains operating with the reduced speed Rf.

The standby mode is switched off in step 340 in a corresponding manner to it previously being switched on, i.e. manually or automatically, after which the speed of the motor(s) and the operating speed is increased until the process speed Rf is achieved. Thereafter the feeding of material into the crushing plant 100 is enabled again in step 380 and the operation of the crushing plant 100 continues in the process mode.

Without in any way limiting the scope, interpretation or possible applications of the invention, reducing of the energy consumption and the noise production can be considered technical advantages of different embodiments of the invention. Further, prolonging the lifetime of components of the mineral material processing plant can be considered a technical advantage of different embodiments of the invention. Further, increasing the environmental friendliness of the mineral material processing plant can be considered a technical advantage of different embodiments of the invention. Further, improving the safety of the mineral material processing plant can be considered a technical advantage of different embodiments of the invention. Further, increasing the effective operating hours of the mineral material processing plant can be considered a technical advantage of different embodiments of the invention.

The foregoing description provides non-limiting examples of some embodiments of the invention. It is clear to a person skilled in the art that the invention is not restricted to details presented, but that the invention can be implemented in other equivalent ways. Some of the features of the above-disclosed embodiments may be used to advantage without the use of other features.

As such, the foregoing description shall be considered as merely illustrative of the principles of the invention, and not in limitation thereof. Hence, the scope of the invention is only restricted by the appended claims.

The invention claimed is:

1. A method for controlling a mineral material processing plant including a crusher actuator and a conveyor actuator, comprising:

receiving mineral material by a feeder;

receiving the mineral material from the feeder by a crusher;

using the crusher actuator to drive the crusher;

crushing material by the crusher, wherein the crusher is a jaw crusher, a cone crusher or a gyratory crusher;

using the conveyor actuator to drive a conveyor and conveying material crushed by the crusher by the conveyor;

giving to the processing plant a command to switch to a standby mode;

switching to the standby mode in response to the command;

limiting mineral material feeding to the processing plant in response to the switching to the standby mode; and keeping the crusher actuator and the conveyor actuator in operation at a standby speed in the standby mode, wherein the standby speed is reduced from a processing speed.

2. The method of claim 1, wherein the command to switch to the standby mode is given by operating a switch.

3. The method of claim 1, wherein the command to switch to the standby mode is given automatically after a predetermined time has elapsed from fulfilment of a standby mode triggering condition.

4. The method of claim 3, wherein the standby mode triggering condition is a detection or a measuring information of the amount of mineral material to be processed in the processing plant.

5. The method of claim 1, wherein the standby speed is selected in accordance with weather conditions at the mineral material processing plant.

6. The method of claim 1, wherein the standby speed is selected in accordance with an operating location of the mineral material processing plant.

7. The method of claim 1, wherein the feeding of mineral material into the processing plant is limited by stopping the actuators participating in the feeding or by reducing the speed of the actuators participating in the feeding.

8. The method of claim 1, further comprising:

giving to the processing plant a command to switch back to a process mode;

raising the speed of the plurality of actuators from the standby speed to the processing speed in response to said command to switch back to the process mode; and enabling the feeding of mineral material into the processing plant.

9. The method of claim 8, wherein the command to switch to the process mode is given by operating a switch.

10. The method of claim 8, wherein the command to switch to the process mode is given automatically after a predetermined time has elapsed from fulfillment of a process mode triggering condition.

11. The method of claim 10, wherein the process mode triggering condition is a detection or a measuring information of the amount of mineral material to be processed in the processing plant.

12. A mineral material processing plant which processing plant comprises:

a feeder arranged to receive mineral material;

a crusher arranged to receive the mineral material from the feeder, wherein the crusher is a jaw crusher, a cone crusher or a gyratory crusher;

a crusher actuator arranged to drive the crusher;

a conveyor arranged to convey material crushed by the crusher;

a conveyor actuator arranged to drive the conveyor;

a control system;

a switch for switching the processing plant to a standby mode; and wherein the control system is configured to control the processing plant to perform:

keeping the crusher actuator and the conveyor actuator in operation with a reduced standby speed in the standby mode;

giving to the processing plant a command to switch to the standby mode;

switching to the standby mode in response to the command to switch to the standby mode;

limiting by the feeder mineral material feeding to the crusher in response to switching to the standby mode;

reducing a speed of the crusher actuator and the conveyor actuator from a processing speed to the standby speed in response to switching to the standby mode; and ensuring that the crusher actuator and the conveyor actuator remain operating with the standby speed in the standby mode.

13. The mineral material processing plant of claim 12, wherein the processing plant comprises a screen.

14. The mineral material processing plant of claim 12, wherein the processing plant is one of the following; a stationary plant, a track-based plant, a wheel-based plant.

15. The mineral material processing plant of claim 12, wherein the control system is arranged to switch to the standby mode automatically after a predetermined time has elapsed from fulfillment of a standby mode triggering condition.

* * * * *